US010912422B2

(12) United States Patent
Morand

(10) Patent No.: US 10,912,422 B2
(45) Date of Patent: Feb. 9, 2021

(54) BABY BATH-SUPPORT DEVICE

(75) Inventor: Michel Morand, Montréal (CA)

(73) Assignee: ANGELCARE CANADA INC., Montreal (CA)

( * ) Notice: Subject to any disclaimer, the term of this patent is extended or adjusted under 35 U.S.C. 154(b) by 1136 days.

(21) Appl. No.: 14/344,359

(22) PCT Filed: Sep. 10, 2012

(86) PCT No.: PCT/IB2012/001744

§ 371 (c)(1),
(2), (4) Date: Jul. 1, 2014

(87) PCT Pub. No.: WO2013/038248

PCT Pub. Date: Mar. 21, 2013

(65) Prior Publication Data

US 2014/0345042 A1 Nov. 27, 2014

Related U.S. Application Data

(60) Provisional application No. 61/533,375, filed on Sep. 12, 2011.

(51) Int. Cl.
*A47K 3/12* (2006.01)

(52) U.S. Cl.
CPC ..... *A47K 3/127* (2013.01)

(58) Field of Classification Search
CPC ..... A47K 3/064; A47K 3/074; A47K 3/127; A47K 3/164
USPC ..... 297/250.1, 256.16; 4/523, 572.1, 586, 4/587, 611, 659
See application file for complete search history.

(56) References Cited

U.S. PATENT DOCUMENTS

| | | | |
|---|---|---|---|
| 1,560,261 | A | 11/1925 | Kleinschay |
| 2,504,287 | A | 4/1950 | Ward |
| 2,547,743 | A | 4/1951 | Burr |
| 2,760,208 | A | 8/1956 | Mussells |

(Continued)

FOREIGN PATENT DOCUMENTS

| | | | |
|---|---|---|---|
| CN | 201398910 | Y | 2/2010 |
| CN | 201585730 | U | 9/2010 |

OTHER PUBLICATIONS

International Search Report for corresponding application PCT/IB2012/01744 filed Sep. 10, 2012; dated Feb. 1, 2013.

(Continued)

*Primary Examiner* — David P Angwin
*Assistant Examiner* — Nicholas A Ros
(74) *Attorney, Agent, or Firm* — Cantor Colburn LLP

(57) ABSTRACT

A baby bath-support device comprises a frame having a generally rigid body. The rigid body is adapted to be positioned on a surface of a bathing tub or sink. The frame has an opening in the upper portion. The opening comprises a peripheral edge. The opening also comprises a support panel made of a flexible material. The flexible material defines a concave support surface to support a baby laid thereon during bathing. The support panel contains perforations to allow fluid to flow through the support surface. The frame opening also comprises a connection arrangement between the frame and the support for hanging the support panel at the peripheral edge. The support panel is hung to the frame to partially cover the opening.

16 Claims, 5 Drawing Sheets

(56) References Cited

U.S. PATENT DOCUMENTS

| | | | | | |
|---|---|---|---|---|---|
| 2,957,184 | A * | 10/1960 | Smith | A47K 3/024 | 297/452.11 |
| 3,633,222 | A * | 1/1972 | Greenfield | A47K 3/127 | 297/452.14 |
| 4,266,306 | A | 5/1981 | Lee | | |
| 5,588,159 | A * | 12/1996 | Poulson | A47K 3/024 | 4/523 |
| 5,599,063 | A * | 2/1997 | Lister | A47D 1/002 | 297/256.11 |
| 6,243,890 | B1 * | 6/2001 | Yang | A47K 3/024 | 4/572.1 |
| 7,065,805 | B1 * | 6/2006 | Sundberg | A47K 3/127 | 297/256.12 |
| 7,533,425 | B2 * | 5/2009 | Monti | A47K 3/024 | 4/572.1 |
| 7,856,678 | B2 * | 12/2010 | Thorne | A47K 3/024 | 4/572.1 |
| 2011/0041244 | A1 * | 2/2011 | Morelock | A47K 3/127 | 4/572.1 |
| 2011/0083261 | A1 * | 4/2011 | Goergen | A47K 3/127 | 4/572.1 |

OTHER PUBLICATIONS

Written Opinion for corresponding application PCT/IB2012/01744 filed Sep. 10, 2012; dated Feb. 1, 2013.

* cited by examiner

BABY BATH-SUPPORT DEVICE

CROSS-REFERENCE TO RELATED APPLICATIONS

This patent application claims priority on U.S. Provisional Patent Application No. 61/533,375, filed on Sep. 12, 2011.

FIELD OF THE APPLICATION

The present application pertains to baby bath-support devices used to support babies while bathing.

BACKGROUND OF THE ART

Baby bath-support devices are commonly used to support a young baby during the bathing activity. The baby bath-support devices are typically made of a rigid material with an inclined surface supporting the baby in a supine position. The baby lies on the inclined surface, which may feature some antislip material.

Commonly used baby bath-support devices are made of rigid materials and/or fabric. There are thus issues related to the use of such materials. Rigid materials and fabric do not permit an efficient flow and drainage of water about the baby. For instance, spoiled water may remain captive between the baby and the inclined surface, resulting in inefficient washing. Moreover, some fabrics have absorption properties, requiring that the fabrics be washed regularly.

There remains a need to provide an ergonomic, safe and efficient baby bath-support device that overcomes issues associated with the prior art.

SUMMARY OF THE APPLICATION

It is therefore an aim of the present invention to provide a baby bath-support device that addresses issues associated with the prior art.

Therefore, in accordance with the preferred embodiment of the present application, there is provided a baby bath-support device comprising: a frame having a generally rigid body adapted to be positioned on a surface of a bathing tub or sink, the frame defining an opening in an upper portion, the opening comprising a peripheral edge; a support panel made of a flexible material and defining a concave support surface adapted to support a baby laid thereon during bathing, the support panel having a plurality of perforations through the concave support surface to allow a fluid to flow therethrough; and a connection arrangement between the frame and the support for hanging the support panel at the peripheral edge such that the support panel is hung to the frame to cover at least partially the opening.

Further in accordance with the preferred embodiment, the frame comprises a wall defining an annular body, with the opening being a top open end of the annular body.

Still further in accordance with the preferred embodiment, the support panel is connected by the connection arrangement to the full peripheral edge.

Still further in accordance with the preferred embodiment, the annular body flares from a top to a bottom.

Still further in accordance with the preferred embodiment, the device further comprises at least one cutout in the wall of the frame to provide a passage from an undervolume of the frame to an exterior of the frame.

Still further in accordance with the preferred embodiment, the device comprises two of said cutout, with the two cutouts being laterally positioned in the wall with respect to an orientation of a baby laid on the baby bath-support device.

Still further in accordance with the preferred embodiment, a bottom edge of the frame generally lies in a plane, and a plane in which lies the peripheral edge is generally oblique relative to the plane of the bottom edge.

Still further in accordance with the preferred embodiment, the device further comprises at least one gripping strip covering a bottom edge of the frame.

Still further in accordance with the preferred embodiment, the device further comprising a convexity in the top concave surface of the support panel, the convexity being located at a head region with respect to an orientation of a baby laid on the baby bath-support device.

Still further in accordance with the preferred embodiment, the frame defines lateral extensions with respect to an orientation of a baby laid on the baby bath-support device, the lateral extensions projecting upwardly relative to an adjacent portion of the support panel.

Still further in accordance with the preferred embodiment, the frame defines a foot extension with respect to an orientation of a baby laid on the baby bath-support device, the foot extension projecting upwardly relative to an adjacent portion of the support panel.

Still further in accordance with the preferred embodiment, the connection arrangement is a channel and hook arrangement.

Still further in accordance with the preferred embodiment, the support panel is a monolithic piece made of a thermoplastic elastomer.

Still further in accordance with the preferred embodiment, the frame is a monolithic piece made of a polymer.

Still further in accordance with the preferred embodiment, the frame and the support panel are co-molded.

DESCRIPTION OF THE PREFERRED EMBODIMENTS

Figure 1:
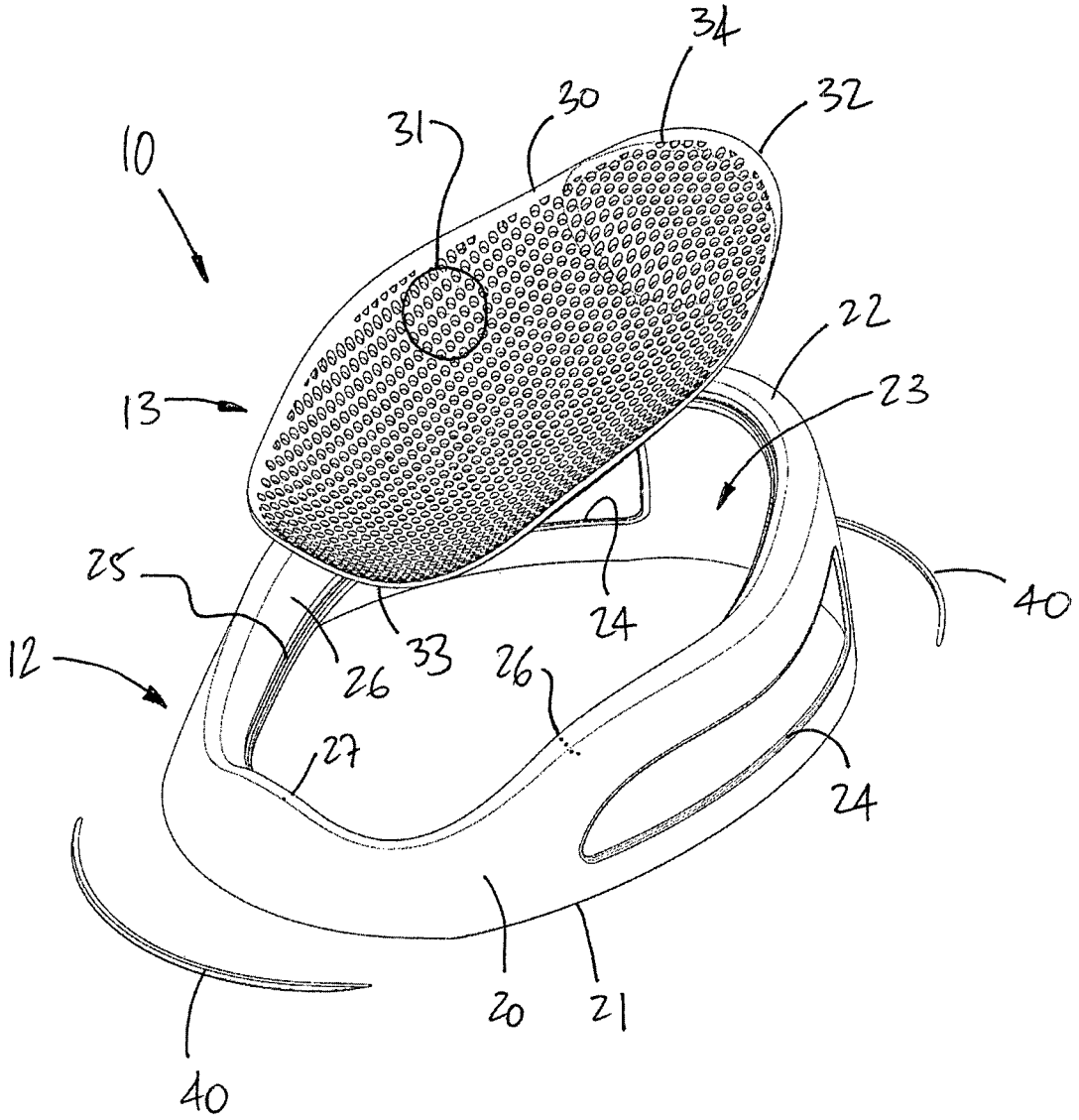
FIG. 1 is an assembly view of a baby bath-support device in accordance with an embodiment of the present disclosure.

Referring to the drawings, and more particularly to FIG. 1, there is illustrated a baby bath-support device for bathing at 10. The baby bath-support device 10 is sized so as to support babies during the bathing activity, in a bathtub. Some versions of the device 10 may be sized to fit in a sink. The baby bath-support device 10 is typically used with newborns, infants and toddlers. The baby bath-support device 10 is particularly well suited to be used with babies who cannot sit stably on their own, and is sized as a consequence. For instance, the baby bath-support device 10 may be used with babies of up to 7-9 months, if not longer.

The baby bath-support device 10 has a frame 12 and a support 13.

The frame 12 is the interface between the ground surface (i.e., surface of the tub or sink) and the support 13.

The support 13 is a sling-like panel that will support the baby during the bathing activity.

Figure 2:
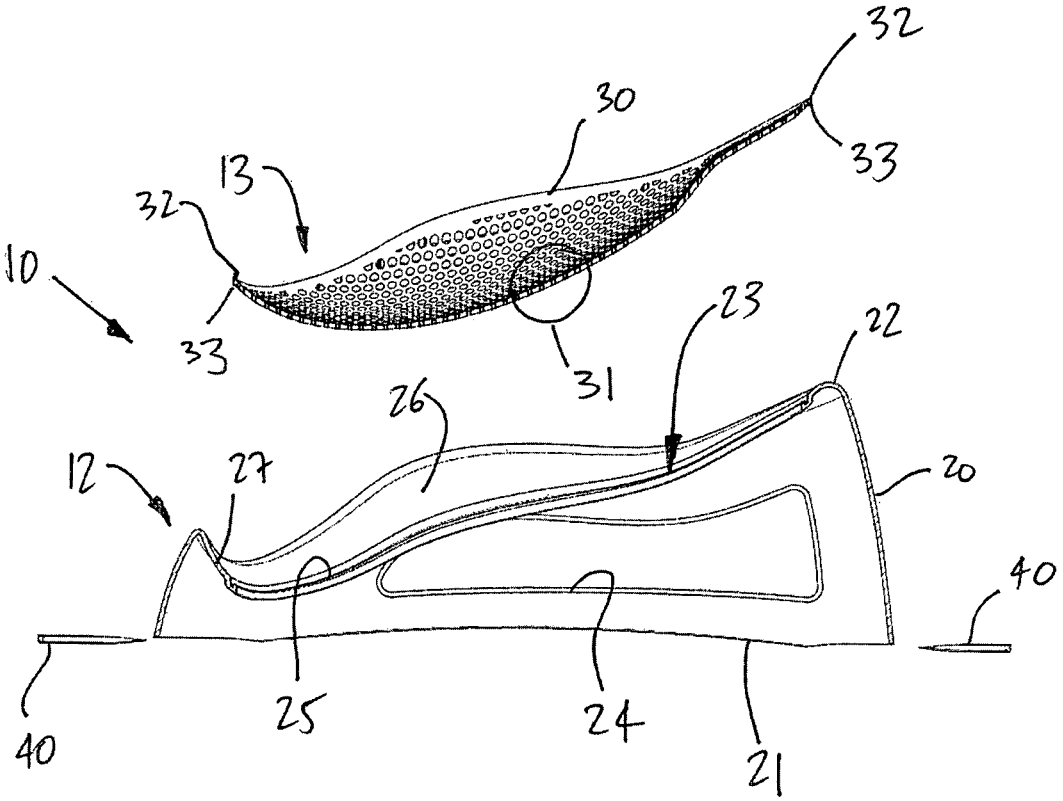
FIG. 2 is a sectional side assembly view of the baby bath-support device of FIG. 1.

Referring concurrently to FIGS. 1-6, the frame 12 is shown made up of a wall 20. The wall 20 is an upstanding wall flaring from top to bottom, to increase a footprint of the device 10 for stability. From an upper viewpoint, the wall 20 defines an annular body. The wall 20 has a bottom edge 21 along its bottom periphery. The bottom edge 21 is generally flat, as it usually lies on the planar surface. However, the bottom periphery of the wall 20 may also be curved, etc, for instance as a function of the type of surface the frame 12 will be rested on. The wall 20 is bounded by a top edge 22. The top edge 22 has a sinuous vertical profile, as best seen in FIG. 2, for reasons stated below.

With the generally annular shape of the wall 20, the frame 12 defines an opening 23. The opening 23 will be covered by the support 13. Lateral cutouts 24 may be provided in opposite sides of the opening 23, and are defined in the wall 20. The frame 12 may have one or more of the cutouts 24. Moreover, it is also considered to provide the wall 20 without any of such cutouts 24.

Figure 5:
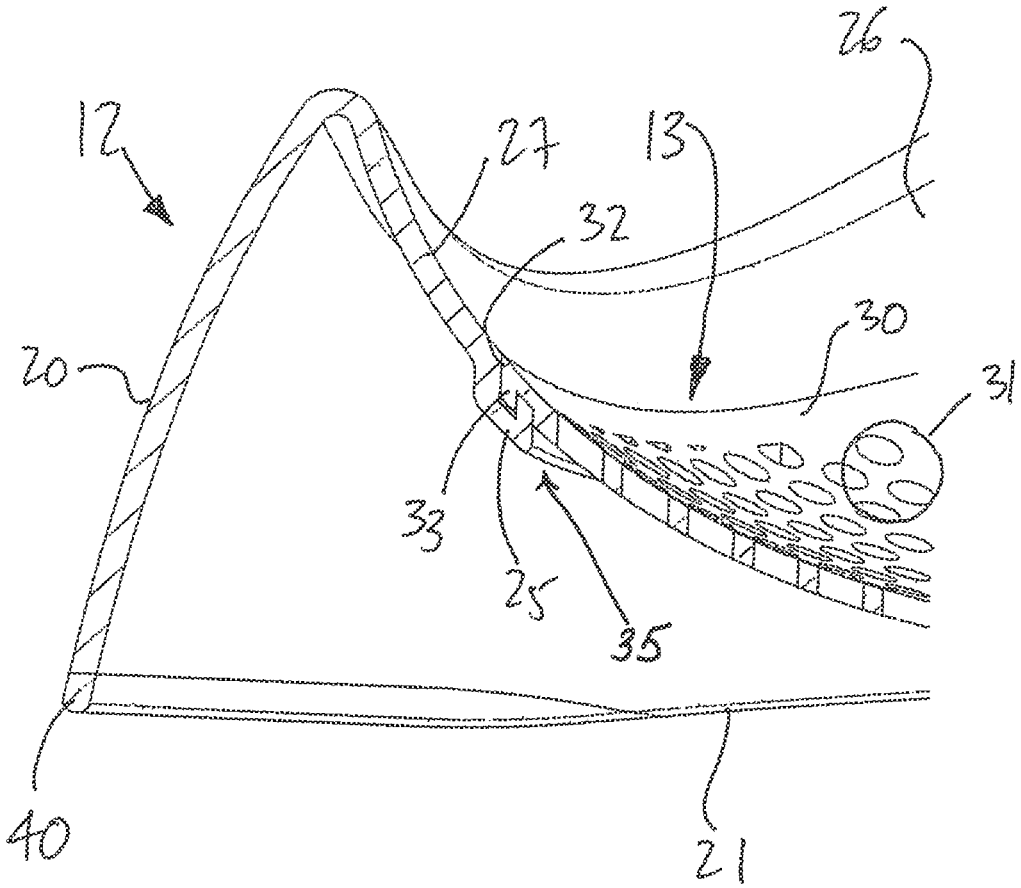
FIG. 5 is an enlarged sectional view of a connection arrangement between a support and a frame of the baby bath-support device of FIG. 1.

Referring concurrently to FIGS. 1, 2 and 5, a peripheral channel 25 is adjacent to the top edge 22. In some locations, the peripheral channel 25 is in close proximity to the top edge 22, whereas in other parts of the frame 12, the peripheral channel 25 is spaced apart from the top edge 22 by a greater distance. More specifically, lateral abutment extensions 26 and front abutment extension 27 project downwardly from the top edge 22 to space the peripheral channel 25 from the top edge 22. Accordingly, abutment surfaces are defined on the sides and in the front of the frame 12, by these extensions 26 and 27. These abutment surfaces will generally prevent the baby from rolling over laterally or slipping downwardly despite the inclination of the support 13.

According to an embodiment, the frame 12 is a one-piece molded unit made of material having a suitable structural integrity. For instance, the frame 12 is made of polymeric materials, such as polypropylene or ABS. Other materials, such as metals and natural fibers, could also be used. However, the materials should be selected as a function of the contemplated use, namely the repeated exposure of the frame 12 to bathing water.

Moreover, the frame 12 may have alternative configurations. For instance, as an alternative to an annular body, the frame 12 may have legs by which the frame 12 rests on a surface. Any appropriate shape of the frame 12 is considered.

Figure 3:
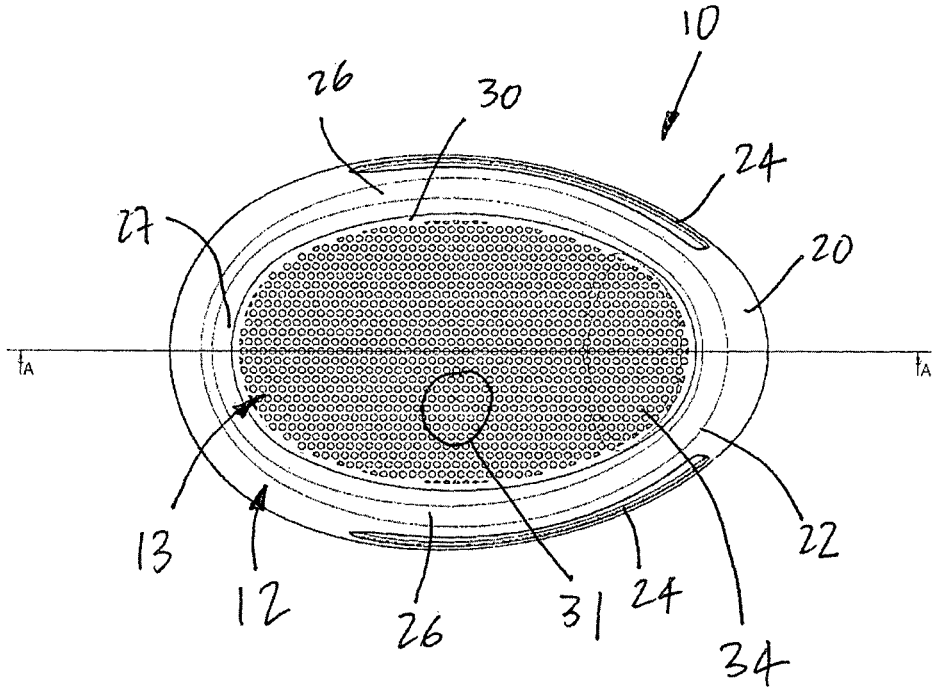
FIG. 3 is a top view of the baby bath-support device of FIG. 1.
Figure 4:
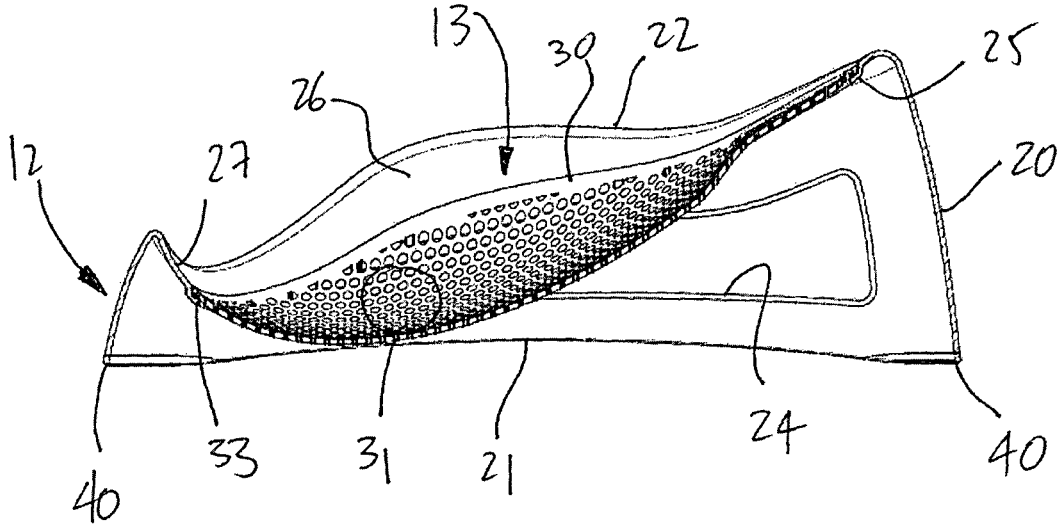
FIG. 4 is a cross-sectional view of the baby bath-support device of FIG. 3, taken along cross-sectional lines A-A.

Referring concurrently to FIGS. 1-3, the support 13 is shown having a panel body 30. The panel body 30 is a sling-like panel that is connected to the support 13. The panel body 30 features a plurality of perforations 31 from top to surface, through which fluid may readily circulate (i.e., holes, throughbores, openings, apertures). The panel body 30 is bound by a peripheral edge 32, which features a hook 33. The hook 33 is shown enlarged in FIG. 5, and projects downwardly from the panel body 30. The hook 33 is shaped so as to matingly engage with the peripheral channel 25 bounding the opening 23 in the frame 12. Accordingly, the combination of hook 23 and peripheral channel 25 is such that the panel body 30 is hung in the opening 23 of the frame 12. Moreover, the arrangement shown in FIG. 5 allows for the support 13 to be removed from the frame 12. The connection arrangement of the channel 25 and hook 33 may be about the full periphery of the opening 23, or alternatively at selected locations, provided the support 13 can sustain the weight of an infant and remain hung.

The connection arrangement may have variants. For instance, the hook may be part of the frame 12, while the receiving channel may be part of the support 13. Moreover, the connection arrangement does not necessarily require a mating relation between the frame 12 and the support 13.

The panel body 30 defines a general concavity in its upper surface, with the exception of a convexity 34. The convexity 34 is located at an upper end of the panel body 30, in the upper surface. Therefore, the body of the toddler is received in the concavity of the panel body 30, with the head being rested on the convexity 34, which acts as a pad or cushion.

The material used for the panel body 30 is a material that may have more resilience than that of the rigid material of the frame 12, for comfort reasons. For instance, the support 13 is relatively flexible, to conform to the shape of the baby, thereby further increasing the stability between the baby and the support 13, in similar fashion to a hammock. Moreover, the material is selected so as to be subjected to the water of a bathing tub. For instance, polymers, and thermoplastic elastomers such as TPR, TPE and/or TPV are well suited to be used for the panel body 30. Alternatives include urethane and silicone, among numerous other possibilities.

The frame 12 and the support 13 are typically molded separately. However, it is contemplated to merge the support 13 to the frame 12 by way of an overmolding process. In such a case, a ledge would be molded over the joint between the hook 33 and the peripheral channel 25 to cover same, the joint 35 being shown in FIG. 5.

Figure 6:
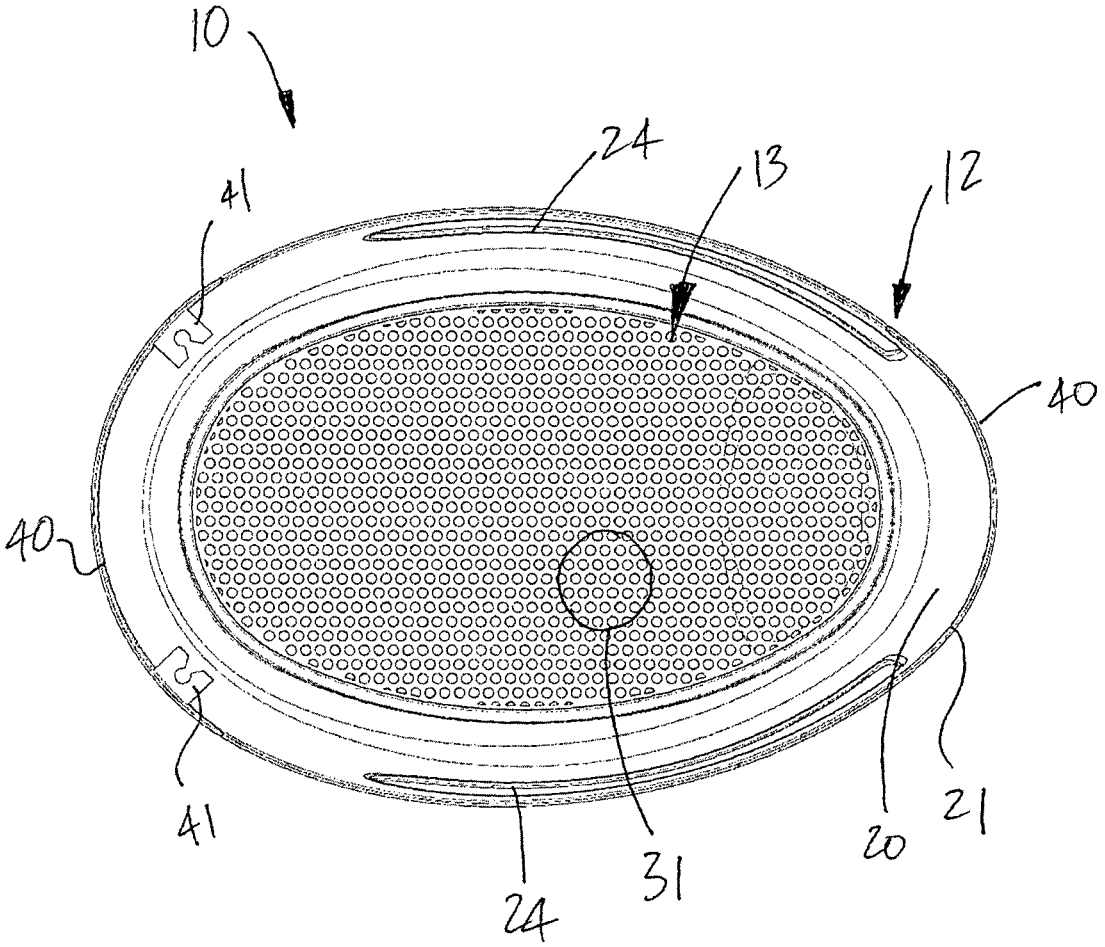
FIG. 6 is a bottom view of the baby bath-support device of FIG. 1.

Referring to FIGS. 1 and 6, gripping strips 40 may be inserted onto the front and the rear of the bottom edge 21. The gripping strips 40 are made of an antislip material increasing the traction between the frame 12 and the support surface of the tub or sink. The gripping strips 40 may be part of a molding process, by which they are overmolded over the frame 12. Alternatively, the gripping strips 40 may be glued onto the frame 12 or connected thereon by interference fit. There may be a single one of the gripping strip 40, covering completely or partly the bottom edge 21.

As seen in FIG. 6, jaws 41 may also be provided additionally or alternatively, typically in a rear area and/or front are of the frame 12, within the frame 12, and are used as interfaces for suction cups.

It is observed that the overall arrangement of the baby bath-support device 10 has the support 13 in an inclined relation relative to the frame 12. This ensures that the baby's head is generally above the torso, as opposed to having the baby horizontal when in a supine position.

Advantageously, the presence of numerous perforations 31 in the panel body 30 allows water drainage and/or circulation through the perforations 31, after the water has been poured onto the baby. The water may then accumulate in the concavity formed by the combination of the frame 12 and the support 13 and optionally flow out of this concavity by the cutouts 24, if cutouts 24 are present. This allows the flow of washing water away from the infant.

Despite the safe nature of the baby bath-support device 10, it is important that adequate supervision be provided during the bathing activity. More specifically, the baby bath-support device 10 should always be used under the careful of a responsible adult, and the infant should not be left unattended in the baby bath-support device 10.

The flared shape of the frame 12 allows the device 10 to be readily stacked. Stacks of the device 10 are thus relatively stable.

For clarity, the rigid nature of the frame 12 and non-rigid flexible nature of the support 13 are detailed. The frame 12 is said to be rigid in that it will generally maintain its shape without deforming excessively when exposed to low bending forces at temperatures similar to that at which the device 10 is used. Likewise, the support 13 is said to be non-rigid and/or flexible in that it will readily deform when exposed to low bending forces at temperatures similar to that at which the device 10 is used.

The invention claimed is:

1. A baby bath-support device comprising:

a frame having a generally rigid body adapted to be positioned on a surface of a bathing tub or sink, the frame defining an opening in an upper portion, the opening comprising a peripheral edge, a bottom edge of the frame having a footprint greater than or equal to a footprint defined by the peripheral edge;

a support panel made of a flexible material and defining a concave support surface adapted to support a baby laid thereon during bathing, the support panel having a plurality of perforations through the concave support surface to allow a fluid to flow therethrough; and a connection arrangement between the frame and the support for hanging the support panel at the peripheral edge such that the support panel is hung to the frame to cover at least partially the opening.

2. The baby bath-support device according to claim 1, wherein the bottom edge of the frame generally lies in a plane, and a plane in which lies the peripheral edge is generally oblique relative to the plane of the bottom edge.

3. The baby bath-support device according to claim 1, further comprising at least one gripping strip covering the bottom edge of the frame.

4. The baby bath-support device according to claim 1, further comprising a convexity in the top concave surface of the support panel, the convexity being located at a head region with respect to an orientation of a baby laid on the baby bath-support device.

5. The baby bath-support device according to claim 1, wherein the frame defines lateral extensions with respect to an orientation of a baby laid on the baby bath-support device, the lateral extensions projecting upwardly relative to an adjacent portion of the support panel.

6. The baby bath-support device according to claim 1, wherein the frame defines a foot extension with respect to an orientation of a baby laid on the baby bath-support device, the foot extension projecting upwardly relative to an adjacent portion of the support panel.

7. The baby bath-support device according to claim 1, wherein the connection arrangement is a channel and hook arrangement.

8. The baby bath-support device according to claim 1, wherein the support panel is a monolithic piece made of a thermoplastic elastomer.

9. The baby bath-support device according to claim 1, wherein the frame is a monolithic piece made of a polymer.

10. The baby bath-support device according to claim 1, wherein the connection arrangement between the frame and the support panel is defined by a co-molded joint.

11. The baby bath-support device according to claim 1, further comprising jaw affixed to the frame and configured for receiving suction cups.

12. The baby bath-support device according to claim 1, wherein the frame comprises a wall defining an annular body, with the opening being a top open end of the annular body, and the bottom edge forming a bottom open end of the annular body.

13. The baby bath-support device according to claim 12, wherein the support panel is connected by the connection arrangement to the full peripheral edge.

14. The baby bath-support device according to claim 12, wherein the annular body flares from a top to a bottom.

15. The baby bath-support device according to claim 12, further comprising at least one cutout in the wall of the frame to provide a passage from an undervolume of the frame to an exterior of the frame.

16. The baby bath-support device according to claim 15, comprising two of said cutout, with the two cutouts being laterally positioned in the wall with respect to an orientation of a baby laid on the baby bath-support device.

* * * * *